US010415908B1

(12) United States Patent
Suk et al.

(10) Patent No.: US 10,415,908 B1
(45) Date of Patent: Sep. 17, 2019

(54) AMMUNITION SUPPLY SYSTEM

(71) Applicant: HANWHA DEFENSE CO., LTD., Changwon-si, Gyeongsangnam-do (KR)

(72) Inventors: Bong Kyung Suk, Changwon-si (KR); Kang Il Lee, Changwon-si (KR); Joo Wan Hwang, Changwon-si (KR)

(73) Assignee: HANWHA DEFENSE CO., LTD., Changwon-si (KR)

( * ) Notice: Subject to any disclaimer, the term of this patent is extended or adjusted under 35 U.S.C. 154(b) by 0 days.

(21) Appl. No.: 16/161,368

(22) Filed: Oct. 16, 2018

(30) Foreign Application Priority Data

Apr. 5, 2018 (KR) ..... 10-2018-0039482

(51) Int. Cl.

| | |
|---|---|
| ***F41A 9/80*** | (2006.01) |
| ***F41A 9/34*** | (2006.01) |
| ***F41A 23/24*** | (2006.01) |
| ***F41H 5/22*** | (2006.01) |
| ***F41H 5/20*** | (2006.01) |
| ***F41H 7/02*** | (2006.01) |
| ***F41A 27/18*** | (2006.01) |

(52) U.S. Cl.
CPC ..... *F41A 9/34* (2013.01); *F41A 23/24* (2013.01); *F41A 27/18* (2013.01); *F41H 5/20* (2013.01); *F41H 5/223* (2013.01); *F41H 7/02* (2013.01)

(58) Field of Classification Search
CPC .. F41A 23/24; F41A 23/00; F41A 9/00; F41A 9/34
See application file for complete search history.

(56) References Cited

U.S. PATENT DOCUMENTS

| | | | | |
|---|---|---|---|---|
| 4,852,461 | A * | 8/1989 | von Laar | F41A 9/375 89/46 |
| 8,726,783 | B2 | 5/2014 | Berkovich et al. | |
| 8,763,511 | B2 * | 7/2014 | Schvartz | F41A 9/34 89/33.14 |
| 8,833,223 | B1 | 9/2014 | Do et al. | |
| 9,285,175 | B2 | 3/2016 | Schvartz et al. | |
| 9,568,267 | B2 * | 2/2017 | Lung | F41A 9/79 |
| 9,644,916 | B2 * | 5/2017 | Hobson | F41A 23/24 |
| 2016/0376927 | A1 | 12/2016 | Mogle, II et al. | |

FOREIGN PATENT DOCUMENTS

| | | | |
|---|---|---|---|
| JP | 3095468 | U | 7/2003 |
| RU | 2482429 | C1 | 5/2013 |
| WO | 9718987 | A1 | 5/1997 |
| WO | 2004020275 | A2 | 3/2004 |

* cited by examiner

*Primary Examiner* — J. Woodrow Eldred
(74) *Attorney, Agent, or Firm* — Sughrue Mion, PLLC

(57) ABSTRACT

An ammunition supply system includes a weapon mounted on an exterior of a fighting vehicle; a magazine loading unit mounted on the exterior of the fighting vehicle and configured to load a magazine for the weapon; a hatch unit configured to form an entrance to allow a combatant to enter and exit the fighting vehicle; and a hatch lifting unit configured to supply power to the hatch unit to move in a vertical direction with respect to the fighting vehicle. The hatch unit includes: a hatch door unit through which the combatant enters and exits the fighting vehicle, and a hatch passage part forming a passage for connecting the hatch door unit and an interior of the fighting vehicle. The hatch passage part includes a first opening facing the magazine loading unit so that the magazine is transferred from the interior of the fighting vehicle to the magazine loading unit without the combatant being exposed to the exterior of the fighting vehicle.

20 Claims, 9 Drawing Sheets

AMMUNITION SUPPLY SYSTEM

CROSS REFERENCE TO THE RELATED APPLICATION

This application claims priority from Korean Patent Application No. 10-2018-0039482 filed on Apr. 5, 2018 in the Korean Intellectual Property Office, the disclosure of which is incorporated herein by reference in its entirety.

BACKGROUND

1. Field

Apparatuses consistent with exemplary embodiments relate to a system for supplying ammunition to a weapon, and more particularly, to a system for supplying ammunition to a weapon mounted on the exterior of a fighting vehicle, using a hatch that moves vertically.

2. Description of the Related Art

For the safety of combatants, weapons mounted on the exterior of the fighting vehicles may be remotely controlled by a combatant inside the fighting vehicle. Because the combatant is spatially separated from the weapon, fighting vehicles needs to be equipped with an ammunition supply system that may continually supply the ammunition to the weapon.

FIG. 1 illustrates an ammunition supply system of the related art. Referring to FIG. 1, an ammunition supply system of the related art includes a weapon 1, and an ammunition supply device 2 mounted inside a fighting vehicle 3. In the ammunition supply system of the related art, ammunition is supplied to the weapon 1 outside the fighting vehicle 3 by the ammunition supply device 2 mounted inside the fighting vehicle 3.

Incidentally, a space is required for mounting the ammunition supply device 2 inside the fighting vehicle 3. A spatial restriction may occur, such as a restriction on the number of combatants that may get on the fighting vehicle 3, due to the space consumed for mounting the ammunition supply device 2 inside the fighting vehicle 3.

Also, due to a case where a failure occurs in a system that remotely controls the weapon, a situation may arise in which the combatant needs to manually operate the weapon mounted on the exterior of the fighting vehicle. In the related art, it was necessary for combatant to get out of the vehicle through the hatch to operate the weapon in such a situation.

Therefore, this disclosure describes a system which is capable of supplying the necessary ammunition and controlling the weapon, while also capable of securing the necessary internal space of the fighting vehicle and the safety of the combatants.

SUMMARY

One of more examplary embodiments provide an ammunition supply system capable of providing additional space inside a fighting vehicle.

One of more examplary embodiments also provide an ammunition supply system capable of protecting combatants even when the weapon is manually and directly operated.

Aspects of the disclosure are not restricted to the above-mentioned aspects, and another aspect which is not mentioned may be clearly understood by those skilled in the art from the description below.

According to an aspect of an exemplary embodiment, there is provided an ammunition supply system according to an exemplary embodiment including a weapon mounted outside a fighting vehicle; a magazine loading unit which is mounted outside the fighting vehicle and loads a magazine supplied to the weapon; a hatch unit which is located near the weapon and forms an entrance to allow a combatant to enter and exit the fighting vehicle; and a hatch lifting unit which provides power to the hatch unit to rise and fall in a vertical direction of the fighting vehicle, wherein the hatch unit includes: a hatch door unit which forms a gate through which the combatant enters and exits, and a hatch passage part which forms a passage for connecting the hatch door unit and the inside of the fighting vehicle, and, a first opening opened toward the magazine loading unit is formed in the hatch passage part so that the loaded magazine can be provided from the inside of the fighting vehicle.

The hatch passage part may include at least one outer wall which surrounds the passage, and a length of the at least one outer wall protruding to the outside of the vehicle may change as the hatch unit rises and falls.

The at least one outer wall may include a plurality of outer walls, a diameter of one of the plurality of outer walls is different from a diameter of the other outer wall, and the at least two covers may overlap each other when the hatch unit falls.

A second opening opened toward the first opening may be formed in the magazine loading unit so that the magazine may be carried in and out.

The hatch lifting unit may include at least one actuator for generating the power.

The at least one actuator may be made up of a linear actuator which directly transmits the power to the hatch unit.

The hatch lifting unit may further include a power transmission unit which transmits the power generated by the at least one actuator to the hatch unit.

A third opening opened toward the weapon may be formed in the hatch unit so that a combatant inside the fighting vehicle may access the weapon.

The ammunition supply system may further include an ammunition measuring unit which measures the number of remaining ammunition loaded on the magazine loading unit; and a magazine replacement reporting unit which outputs a magazine replacement alarm for reporting the replacement timing of the magazine when the number of the measured remaining ammunition is equal to or less than a reference value.

Other specific matters of the present disclosure are included in the detailed description and the drawings.

According to the exemplary embodiment, at least the following effects are obtained.

According to the exemplary embodiment, because the magazine loading unit for loading the magazine to be supplied to the weapon is mounted on the exterior of the vehicle, it is possible to secure additional space inside the fighting vehicle.

Further, according to the exemplary embodiment, in order to supply the magazine to the magazine loading unit, because the combatant may raise and lower the hatch, without the need for going out of the vehicle, the magazine may be stably supplied to the magazine loading unit in a state in which the combatant is not exposed to the outside.

Further, according to the exemplary embodiment, in order for a combatant to directly operate a weapon manually, because the combatant may raise and lower the hatch without going out of the vehicle, the combatants are not exposed to the outside and the weapon can be stably and manually controlled.

The effects of the inventive concept are not restricted by the contents exemplified above, and various effects are further included in the present specification.

According to an aspect of another exemplary embodiment, there is provided an ammunition supply system including: a weapon mounted on an exterior of a fighting vehicle; a magazine loading unit mounted on the exterior of the fighting vehicle and configured to load a magazine for the weapon; a hatch unit configured to form an entrance to allow a combatant to enter and exit the fighting vehicle; and a hatch lifting unit configured to supply power to the hatch unit to move in a vertical direction with respect to the fighting vehicle. The hatch unit may include: a hatch door unit through which the combatant enters and exits the fighting vehicle, and a hatch passage part forming a passage for connecting the hatch door unit and an interior of the fighting vehicle. The hatch passage part may include a first opening facing the magazine loading unit so that the magazine is transferred from the interior of the fighting vehicle to the magazine loading unit without the combatant being exposed to the exterior of the fighting vehicle.

The hatch passage part may include at least one outer wall which surrounds the passage, and a height of the at least one outer wall protruding to the exterior of the fighting vehicle changes as the hatch unit moves vertically.

The at least one outer wall may include a plurality of outer walls. A diameter of one of the plurality of outer walls may be different from a diameter of an adjacent outer wall. At least two outer walls of the plurality of outer walls overlap each other in response the hatch unit being lowered.

The first opening may be exposed to the exterior of the fighting vehicle when the hatch unit rises.

The hatch lifting unit may include at least one actuator configured to generate the power for the hatch unit to move vertically.

The at least one actuator may include a linear actuator configured to transmit the power to the hatch unit.

A first end of the linear actuator may be mounted on the fighting vehicle, and a second end opposite to the first end of the linear actuator may be mounted to the hatch passage part.

The hatch lifting unit may further include a power transmission unit configured to transmit the power generated by the at least one actuator to the hatch unit.

The at least one actuator may include a circular actuator configured to generate a rotational power. The power transmission unit may include: a first gear configured to be rotated by the generated rotational power, and a second gear configured to convert the rotation of the first gear into a linear power and configured to transmit the linear power to the hatch unit.

The first gear may be mounted on the fighting vehicle, and the second gear may be mounted on the hatch passage part.

The ammunition supply system may further include: an ammunition measuring unit configured to measure a number of remaining ammunition loaded in the magazine loading unit; and a magazine replacement reporting unit configured to output a magazine replacement alarm for reporting replacement timing of the magazine when a number of the measured remaining ammunition is equal to or less than a reference value.

The magazine replacement alarm may be output through at least one of a warning lamp, a display panel, or a speaker mounted inside the fighting vehicle.

The magazine loading unit may include a second opening facing the first opening so that the magazine is loaded from the first opening.

The hatch unit may further include a first cover mounted at the first opening to open or close the first opening.

The first cover may be provided with a hinge provided at a lower end of the first cover, and is opened by rotating toward the outside of the fighting vehicle, and the first cover includes a stopper configured to restrict a rotation angle of the first cover so that an upper end of the first cover is located near a lower end of the second opening in an open state of the first opening.

The first cover may include a guide rail provided on the first cover and configured to to guide the magazine sliding and moving from the interior of the fighting vehicle to the magazine loading unit.

The first cover comprises a first hinge provided at a side end of the first cover, and is opened by rotating toward the outside of the fighting vehicle, and the first cover may include: an auxiliary cover opened and closed by a second hinge located at a lower end of the first cover; and a stopper configured to restrict a rotation angle of the auxiliary cover such that one end of the auxiliary cover is located near a lower end of the second opening in a state in which the first cover and the auxiliary cover are opened.

The magazine loading unit may further include a second cover mounted a the second opening.

The hatch unit may further include a third opening opened toward the weapon so as to allow the combatant to access the weapon.

The third opening may be exposed to the exterior of the fighting vehicle when the hatch unit moves upward.

BRIEF DESCRIPTION OF THE DRAWINGS

The above and/or other aspects and features of the disclosure will become more apparent by describing in detail exemplary embodiments thereof with reference to the attached drawings, in which.

DETAILED DESCRIPTION

Figure 1:
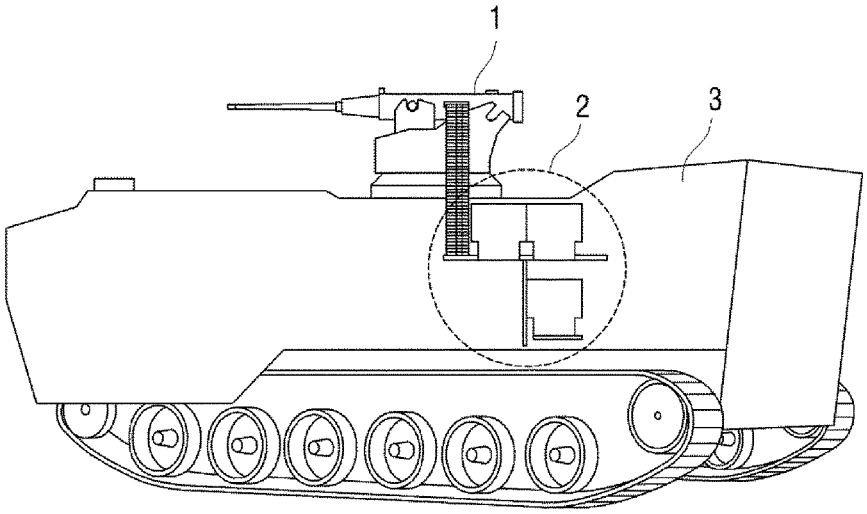
FIG. 1 illustrates an ammunition supply system of the related art.

Advantages and features of the inventive concept and methods of accomplishing the same may be understood more readily by reference to the following detailed description of preferred exemplary embodiments and the accompanying drawings. The inventive concept may, however, be embodied in many different forms and should not be construed as being restricted to the exemplary embodiments set forth herein. Rather, these exemplary embodiments are provided so that this disclosure will be thorough and complete and will fully convey the concept of the inventive concept to those skilled in the art, and the inventive concept will only be defined by the appended claims. Same reference numerals refer to same elements throughout the specification.

Unless otherwise defined, all terms (including technical and scientific terms) used in this specification may be used in the meaning that can be understood in common by those having ordinary skill in the technical field to which the inventive concept belongs. Also, the terms commonly used and predefined are not interpreted ideally or unduly unless expressly defined otherwise.

The terms used in the present specification are for the purpose of describing the examples and do not restrict the inventive concept. In the specification, the singular form also includes the plural forms unless specifically stated in a phrase. The terms "comprises" and/or "comprising" used in the specification do not exclude the presence or addition of one or more other constituent elements, in addition to the referenced constituent elements.

Hereinafter, preferred exemplary embodiments of the disclosure will be described in detail with reference to the attached drawings.

Figure 2A:
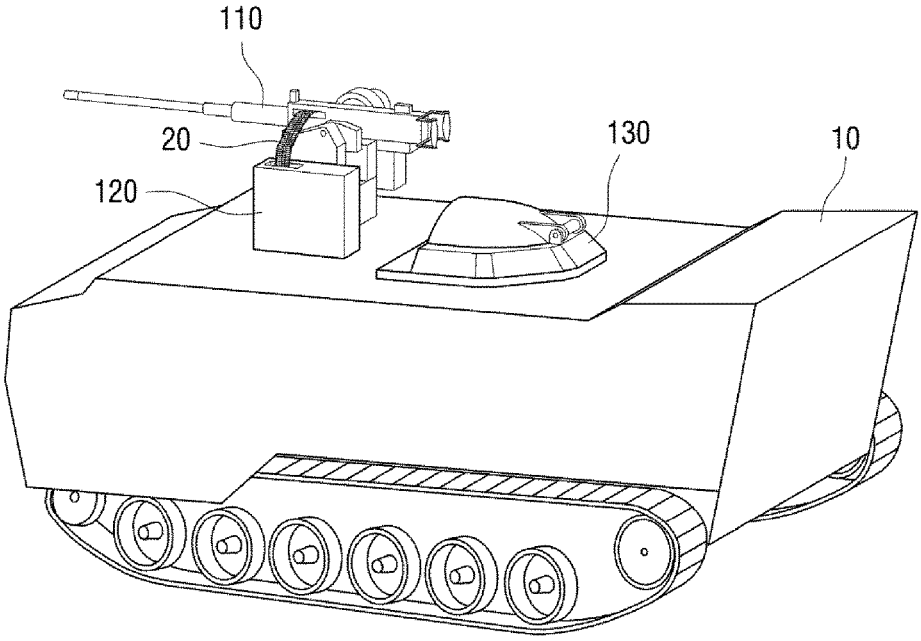
FIGS. 2A, 2B and 3 illustrate an ammunition supply system according to an exemplary embodiment.
Figure 2B:
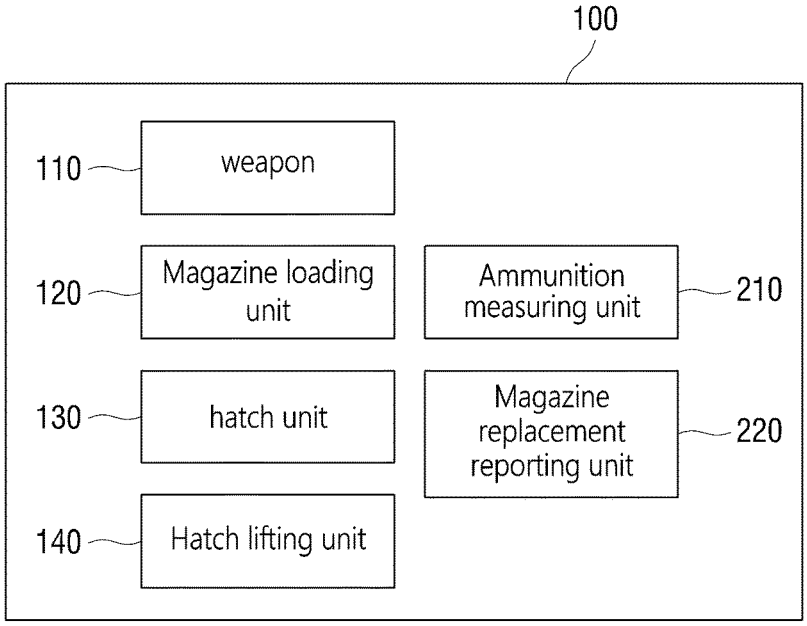
Figure 3:
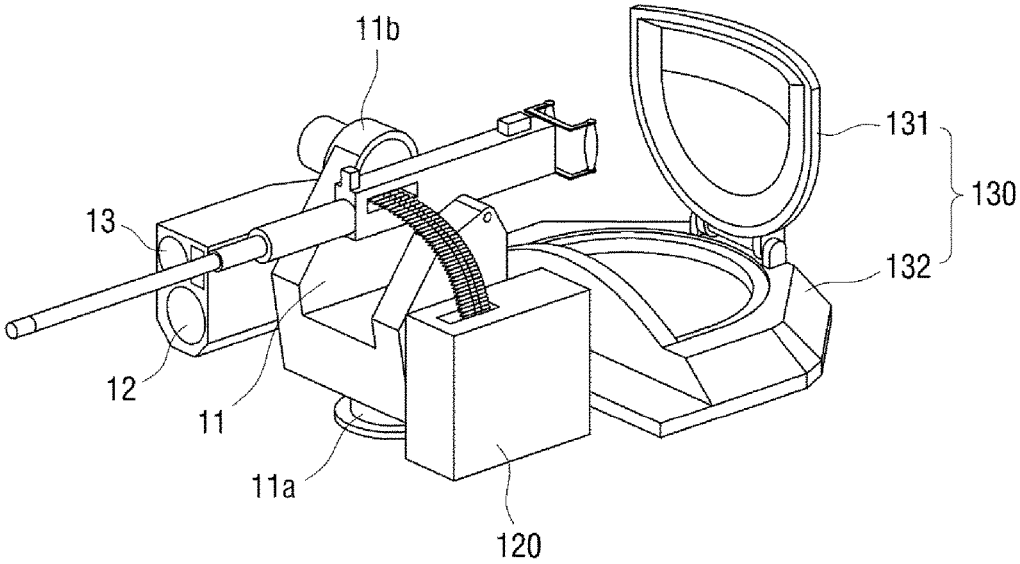
Figure 10:
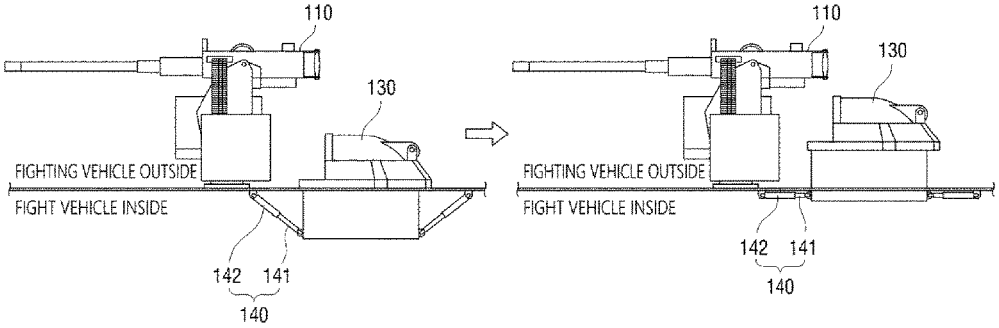
FIG. 10 illustrates an exemplary embodiment of a method of providing power to a hatch unit to rise and fall by a hatch lifting unit.

FIGS. 2A, 2B and 3 illustrate an ammunition supply system 100 according to an exemplary embodiment. The ammunition supply system 100 according to an exemplary embodiment includes a weapon 110, a magazine loading unit 120, an ammunition measuring unit 210, a magazine replacement reporting unit 220, a hatch unit 130, and a hatch lifting unit 140 (FIG. 10). FIG. 2B illustrates a block diagram representing the ammunition supply system 100 according to an exemplary embodiment.

The weapon 110 may be loaded on a weapon mount 11 provided on an upper side of the fighting vehicle 10. The weapon 110 which is a subject of this disclosure may be, but is not limited to, a machine gun capable of continuously shooting at the targets.

The weapon mount 11 is provided with a first rotating unit 11*a* which rotates in a clockwise or counter-clockwise direction, and a second rotating unit 11*b* which rotates the weapon 110 in a vertical direction. The weapon 110 is rotated by the first rotating unit 11*a* and the second rotating unit 11*b*, and may be aimed in the vertical direction and the left-right (clockwise and counter-clockwise) direction.

An imaging device 12 capable of capturing an image of a target of the weapon 110, and a distance measuring sensor 13 capable of measuring the distance between the target and the weapon 110 may be mounted on one side of the weapon mount 11. The imaging device 12 may consist of different types of cameras such as a zoom type camera, a dome type camera, a PTZ camera and an IR camera, but is not limited thereto. The distance measuring sensor 13 may consist of a laser rangefinder (LRF). When using the LRF, it is possible to measure the velocity of a moving target, using Doppler effect together with the distance measurement.

A magazine 21 (FIG. 4) to be supplied to the weapon 110 may be loaded on the magazine loading unit 120. The ammunition may be supplied to the weapon 110 from the magazine loaded in the magazine loading unit 120. For example, because one end of the ammunition belt 20 provided to the weapon 110 is linked with the other end of the ammunition belt 20 loaded on the magazine 21, the ammunition loaded on the magazine 21 may be continuously provided to the weapon 110 from the ammunition belt 20 provided to the weapon 110.

Figure 4:
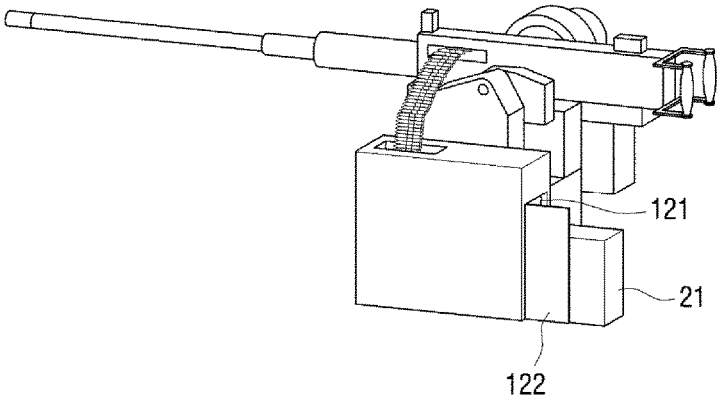
FIG. 4 illustrates a second opening formed in a magazine loading unit of the ammunition supply system according to an exemplary embodiment.

The magazine loading unit 120 will be described in more detail referring to FIG. 4 along with FIGS. 2 and 3. An opening 121 may be formed in the magazine loading unit 120 through which the magazine 21 can be loaded and unloaded. The opening 121 may be formed to open toward the hatch unit 130 so that the magazine 21 can easily be loaded/unloaded from the hatch unit 130. A cover 122 is mounted on the opening 121, and the magazine 21 mounted on the magazine loading unit 120 can be protected by the cover 122 from the outside.

The ammunition measuring unit 210 may measure the number of ammunition remaining in the magazine loading unit 120. To this end, the ammunition measuring unit 210 calculates the number of ammunition carried into in the magazine loading unit 120 from the number of ammunition loaded on the magazine loading unit 120 and the number of ammunition included in the magazine, and calculates the number of ammunition carried out of the magazine loading unit 120 from the number of ammunition which are shot from the weapon, and then subtracts the number of carried-out ammunition from the number of carried-in ammunition, thereby measuring the number of ammunition remaining in the magazine loading unit 120.

The magazine replacement reporting unit 220 may output a magazine replacement alarm which reports the replacement timing of the magazine loaded on the magazine loading unit. The magazine replacement reporting unit 220 may output the magazine replacement alarm, when the number of remaining ammunition measured in the ammunition measuring unit 210 is equal to or less than a reference/threshold value. The magazine replacement reporting unit 220 may output the magazine replacement alarm to a fighting vehicle operation display mounted inside the fighting vehicle, thereby reporting to the combatant who gets on the fighting vehicle of the magazine replacement timing. For example, the magazine replacement alarm may be output in various ways, such as turning-on of the alarm lamp, playback of warning sound, and warning message displayed on the display panel.

The ammunition measuring unit 210 and the magazine replacement reporting unit 220 may be implemented as variety numbers hardware and/or software configurations executing certain functions. For example, the controller 500 may denote a data processing device built in hardware, and includes a physically structured circuit for executing functions expressed as codes or commands included in a program.

More specifically, at least one of the components, elements, modules or units of the ammunition measuring unit 210 and the magazine replacement reporting unit 220 in FIG. 2B may be embodied as various numbers of hardware, software and/or firmware structures that execute respective functions described above, according to an exemplary embodiment. For example, at least one of these components, elements, modules or units may use a direct circuit structure, such as a memory, a processor, a logic circuit, a look-up table, etc. that may execute the respective functions through controls of one or more microprocessors or other control apparatuses. The ammunition measuring unit 210 and the magazine replacement reporting unit 220 need to be able to perform a basic logical operation, it is possible to use, but is not limited to, a semiconductor element capable of performing the logical operation, such as a central processing unit (CPU), a micro controller unit (MCU), a microprocessor, a field programmable gate array (FPGA), and an application specific integrated circuit (ASIC).

Also, at least one of these components, elements, modules or units may be specifically embodied by a module, a program, or a part of code, which contains one or more executable instructions for performing specified logic functions, and executed by one or more microprocessors or other control apparatuses. Also, at least one of these components, elements, modules or units may further include or may be implemented by a processor such as a central processing unit (CPU) that performs the respective functions, a microprocessor, or the like. Two or more of these components, elements, modules or units may be combined into one single component, element, module or unit which performs all operations or functions of the combined two or more components, elements, modules or units. Also, at least part of functions of at least one of these components, elements, modules or units may be performed by another of these components, elements, modules or units. Further, although a bus is not illustrated in the above block diagrams, communication between the components, elements, modules or units may be performed through the bus. Functional aspects of the above exemplary embodiments may be implemented in algorithms that execute on one or more processors. Furthermore, the components, elements, modules or units represented by a block or processing steps may employ any number of related art techniques for electronics configuration, signal processing and/or control, data processing and the like.

Figure 5:
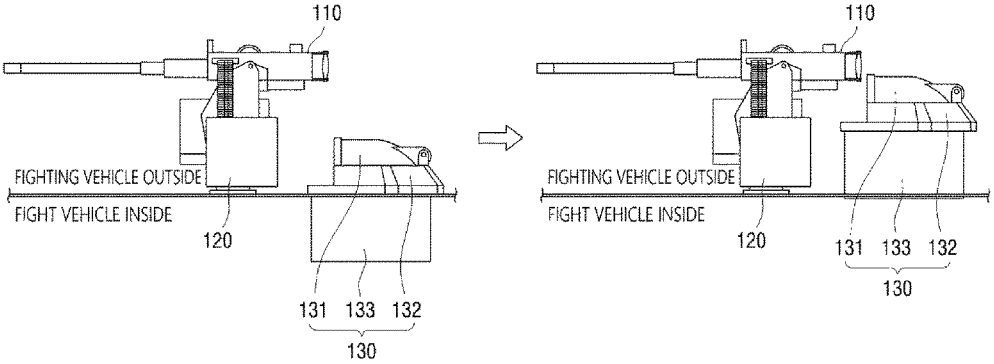
FIG. 5 illustrates a hatch unit that is raised and lowered in the ammunition supply system according to an exemplary embodiment.

Next, the hatch unit 130 will be described referring to FIG. 5 along with FIGS. 2 and 3. A diagram on a left side of FIG. 5 illustrates an exemplary embodiment in a state in which the hatch unit 130 is lowered, and a diagram on a right side of FIG. 5 illustrates an exemplary embodiment in a state in which the hatch unit 130 is raised.

The hatch unit 130 may form an entrance through which combatants may enter and exit the fighting vehicle 10. The hatch unit 130 includes a hatch door unit 131 forming a gate, a hatch door fixing unit 132, and a hatch passage part 133 which forms a passage for entering the fighting vehicle 10 from the hatch door unit 131.

The hatch passage part 133 may be constituted as one outer wall which forms a passage. In the one outer wall, a length (or a height) exposed to the outside of the fighting vehicle 10 may change as the hatch unit 130 rises and falls (i.e., moves vertically up and down).

Figure 6:
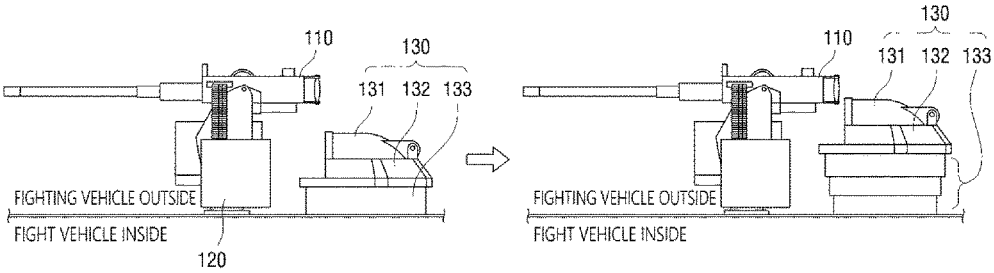
FIG. 6 illustrates another method of constructing a hatch passage part in the ammunition supply system according to an exemplary embodiment.

Alternatively, as illustrated in FIG. 6, the hatch passage part 133 may be made up of a plurality of outer walls to form a passage. A diagram on a left side of FIG. 6 illustrates an exemplary embodiment in a state in which the hatch unit 130 is lowered, and a diagram on a right side of FIG. 6 illustrates an exemplary embodiment in a state in which the hatch unit 130 is raised. The plurality of outer walls is configured to have different diameters, and may be overlapped with one another when the hatch unit 130 is in the lowered state.

In the exemplary embodiment, explanation will be made assuming that the hatch passage part 133 is configured as illustrated in FIG. 5. This is only for convenience of explanation and does not exclude the configuration illustrated in FIG. 6.

The hatch passage part 133 will be described in more detail referring to FIG. 7 along with FIGS. 3, 5 and 6. An opening 134 may be formed in the hatch passage part 133 so that the magazine 21 may be carried in and out of the hatch passage part 133. In order to avoid confusing terms, the opening 134 formed in the hatch passage part 133 is referred to as a first opening 134, and the opening 121 illustrated in FIG. 4 is referred to as a second opening 121.

The first opening 134 may be formed to open toward the second opening 121 so that the magazine 21 may be easily provided to the magazine loading unit 120 from the hatch passage part 133. The cover 135 may be mounted on the first opening 134 to be able to protect combatants inside the fighting vehicle 10.

Each of the covers 135, 122 mounted on the hatch passage part 133 to cover the first opening 134 and the second opening 121 is opened outward, and may perform a function of a shield which blocks an external attack even in an opened state.

Figure 7:
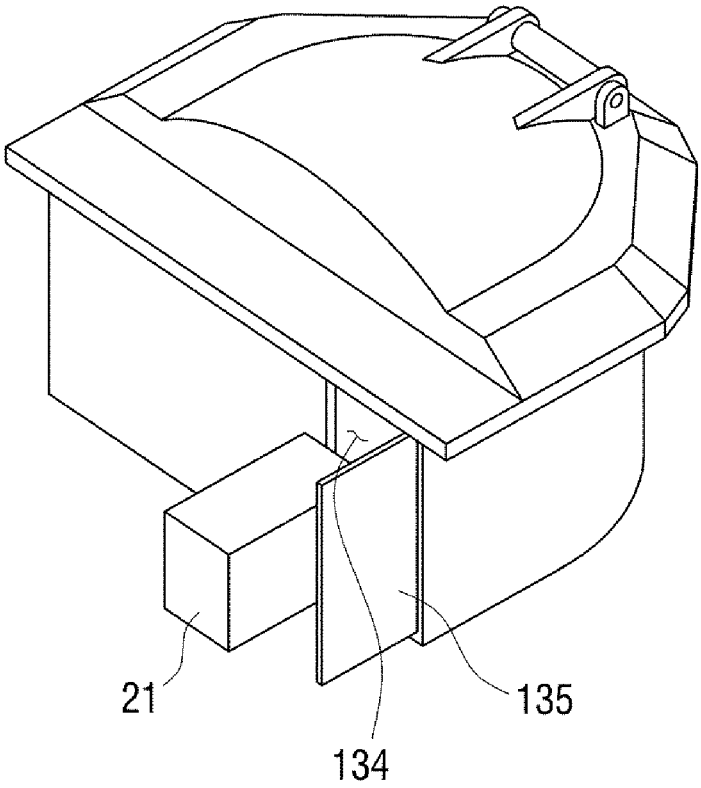
FIG. 7 illustrates a first opening formed in the hatch passage part of the ammunition supply system according to an exemplary embodiment.
Figure 8A:
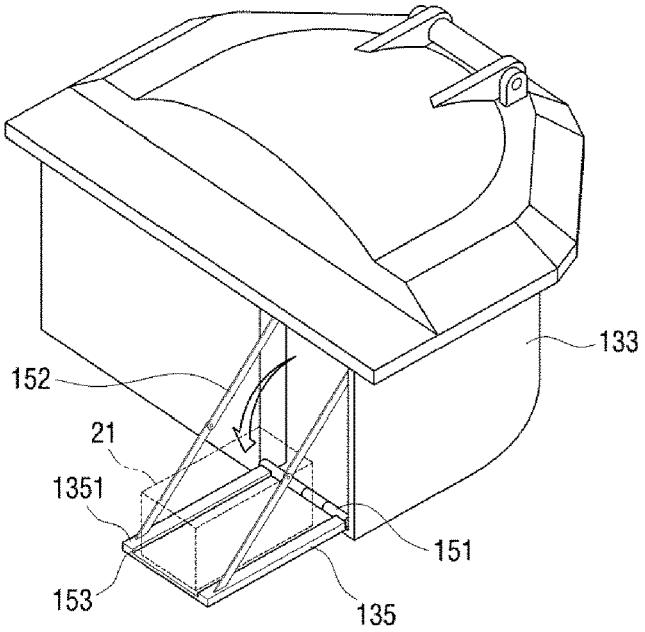
FIGS. 8A to 8C illustrate another embodiment of the cover mounted to the first opening.
Figure 8B:
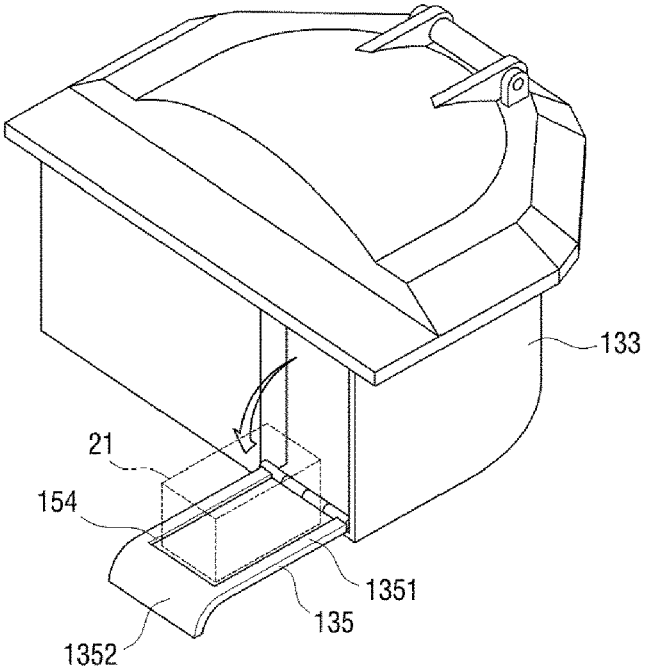
Figure 8C:
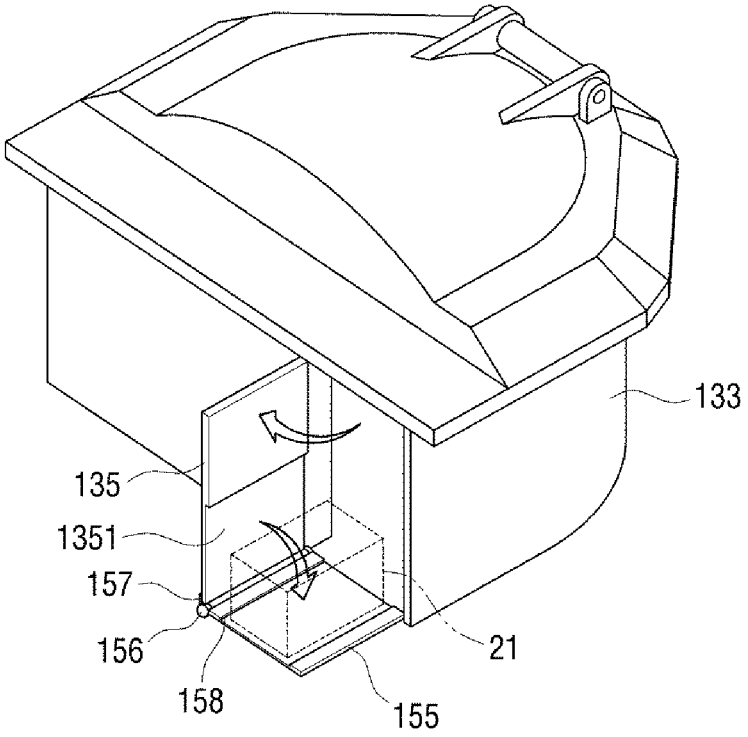

The cover 135 may be mounted on the hatch passage part 133 to cover the first opening 134 in a structure different from that illustrated in FIG. 7. FIGS. 8A to 8C illustrate exemplary embodiments of the cover 135 mounted on the hatch passage part 133 to cover the first opening 134.

Referring to FIG. 8A, a hinge 151 is mounted on a lower end of the cover 135, and the cover 135 may be opened to the outside of the fighting vehicle 10. At this time, because the cover 135 and the hatch passage part 133 are connected to each other via the link member 152, a rotation angle of the cover 135 may be restricted. That is, the link member 152 may perform a function of a stopper for restricting the rotation angle of the cover 135.

The cover 135 may be fixed at a specific angle due to the link member 152 as illustrated in FIG. 8A during rotation. More specifically, the upper end of the cover 135 may be fixed so as to be located near the lower end of the second opening 121 of the magazine loading unit 120. With such a configuration, because the cover 135 is placed like a bridge between the first opening 134 of the hatch unit 130 and the second opening 121 of the magazine loading unit 120, the combatants inside the fighting vehicle 10 may be able to place the magazine 21 on the cover 135, and may push and move the magazine 21 to the magazine loading unit 120 without being exposed to attacks. At this time, because a guide rail 153 is formed on an inner side surface 1351 of the cover 135, the magazine 21 may be guided so as to move in a correct direction.

Or, the cover 135 may be configured as illustrated in FIG. 8B. Referring to FIG. 8B, the cover 135 may be formed with a bent part 1352 in which an upper end is bent toward the outside of the fighting vehicle 10.

As illustrated in FIG. 8B, when the cover 135 is opened, the bent part 1352 abuts against a top surface of the fighting vehicle 10, and the cover 135 may be fixed, at a specific angle after rotation to be opened. Likewise, with this configuration, because the cover 135 is placed like a bridge between the first opening 134 and the second opening 121, the magazine 21 placed on the cover 135 may slide along the guide rail 154 and may be moved to the magazine loading unit 120 through the second opening 121.

Or, the cover 135 may be configured as illustrated in FIG. 8C. Referring to FIG. 8C, the cover 135 may be opened outward by a side hinge (not shown; provide behind the cover 135 in FIG. 8).

An auxiliary cover 155 may be provided on an inner side surface 1351 of the cover 135. The auxiliary cover 155 may be rotated and opened by the hinge 156 at the lower end of the cover 135.

The rotation angle of the auxiliary cover 155 may be restricted by a protrusion 157 formed on the hinge 156. More specifically, because the protrusion 157 protruding from the auxiliary cover 155 and is configured to be caught by the cover 135 at a certain rotation angle of the auxiliary cover 155, the rotation angle of the auxiliary cover 155 may be restricted by the protrusion 157 contacting the cover 135. That is, the protrusion 157 may perform the function of a stopper that restricts the rotation angle of the auxiliary cover 155. The auxiliary cover 155 may be fixed so as to be located near the lower end of the second opening 121 of the magazine loading unit 120 in a state of the protrusion 157 abutting the cover 135.

Likewise, with this configuration, because the auxiliary cover 155 is placed like a bridge between the first opening 134 of the hatch unit 130 and the second opening 121 of the magazine loading unit 120, the magazine 21 may be placed on the auxiliary cover 155 and may be pushed to move to the magazine loading unit 120. Even in this case, because a guide rail 158 is formed on the inner surface of the auxiliary cover 155, the magazine 21 may be guided to move in the correct direction.

As described above referring to FIGS. 8A to 8C, because the cover 135 or the auxiliary cover 155 is placed like a bridge between the first opening 134 and the second opening 121, the combatant may place the magazine 21 on the cover 135 or the auxiliary cover 155 and push and move the magazine 21 to the magazine loading unit 120, without the need for picking and moving the magazine 21 to the magazine loading unit 120. Therefore, even in a tense situation such as a war situation, the combatant may more safely and easily supply the magazine 21 to the magazine loading unit 120 from the hatch unit 130.

Figure 9:
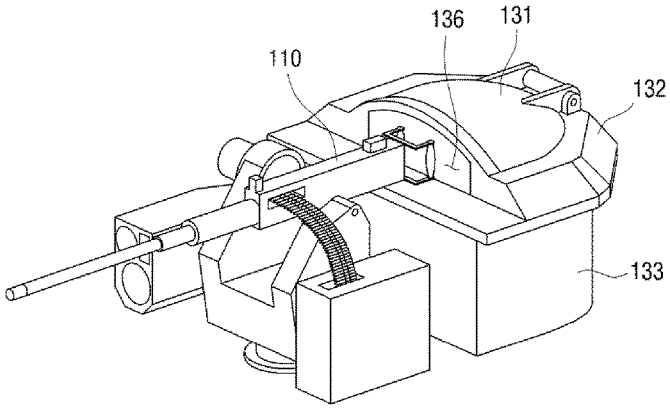
FIG. 9 illustrates a third opening formed in a hatch door fixing unit of the ammunition supply system according to an exemplary embodiment.

Next, the hatch door fixing unit 132 will be described in more detail referring to FIG. 9. The hatch door fixing unit 132 may be formed with a third opening 136 opened toward the weapon 110. The hatch unit 130 rises to a specific position such that the third opening 136 of the hatch door fixing unit 132 is located adjacent to the weapon 110, and the combatant inside the fighting vehicle 10 may easily access the weapon 110 through the third opening 136.

Next, a method of providing power to the hatch unit 130 to be raised or lowered (to move vertically up and down) by the hatch lifting unit 140 will be described with reference to FIGS. 10 and 11.

FIG. 10 illustrates an exemplary embodiment of a method of providing power to the hatch unit 130 to be raised or lowered by the hatch lifting unit 140. In an exemplary embodiment, the hatch lifting unit 140 may include an actuator 140 that directly provides the power so that the hatch unit 130 may move vertically up and down.

More specifically, the hatch lifting unit 140 may include a linear actuator 140, where one end of the linear actuator 140 may be fixed to the inside of the fighting vehicle 10, and the other end (opposite to the one end) thereof may be connected to the hatch passage part 133. In this exemplary embodiment, the linear actuator 140 may include a cylinder 142 and a plunger 141. At this time, the linear actuator 140 may be a hydraulic actuator or an electric actuator. However, the exemplary embodiment is not limited thereto.

When the plunger 141 is pulled out of the cylinder 142, as illustrated on the left side of FIG. 10, the hatch unit 130 falls (or is lowered), and in contrast, when the plunger 141 is inserted into the cylinder 142, the hatch unit 130 may rise (or is raised) as illustrated on the right side of FIG. 10.

Figure 11:
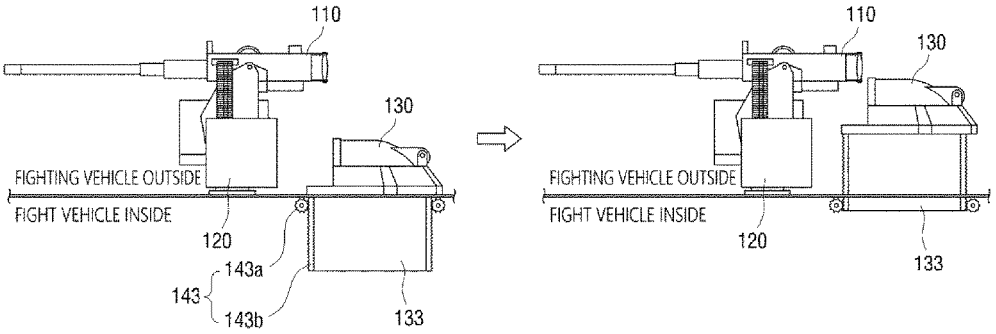
FIG. 11 illustrates an exemplary embodiment of a method of providing power to the hatch unit to rise and fall by the hatch lifting unit.

FIG. 11 illustrates an exemplary embodiment of a method of providing the power to the hatch unit 130 to move vertically up and down by the hatch lifting unit 140. The hatching lifting unit 140 may include an actuator (not illustrated) for providing the power to allow the hatch lifting unit hatch unit 130 to move vertically up and down, and a power transmission unit 143 for transmitting the power generated by the actuator to the hatch unit 130.

More specifically, the actuator is made up of a circular actuator which generates a rotational power, and the power transmission unit 143 may include a first gear 143*a* rotating by receiving power from the motor, and a second gear 143*b* that converts rotational power transmitted from the first gear 143*a* into a linear power and transmits the linear power to the hatch unit 130. For example, the circular actuator may be a motor, the first gear may be a pinion gear, and the second gear may be a rack gear.

With rotation of the first gear 143*a* by the circular actuator, the second gear 143*b* may move in the vertical direction with respect to the fighting vehicle 10. The second gear 143*b* is mounted to the hatch passage part 133, and the hatch unit 130 may rise with the movement of the second gear 143*b* in the vertical direction.

On the basis of the above explanation, a method of supplying ammunition using the ammunition supply system 100 according to the exemplary embodiment, and a method of controlling a weapon 110 by combatant will be described.

Figure 12:
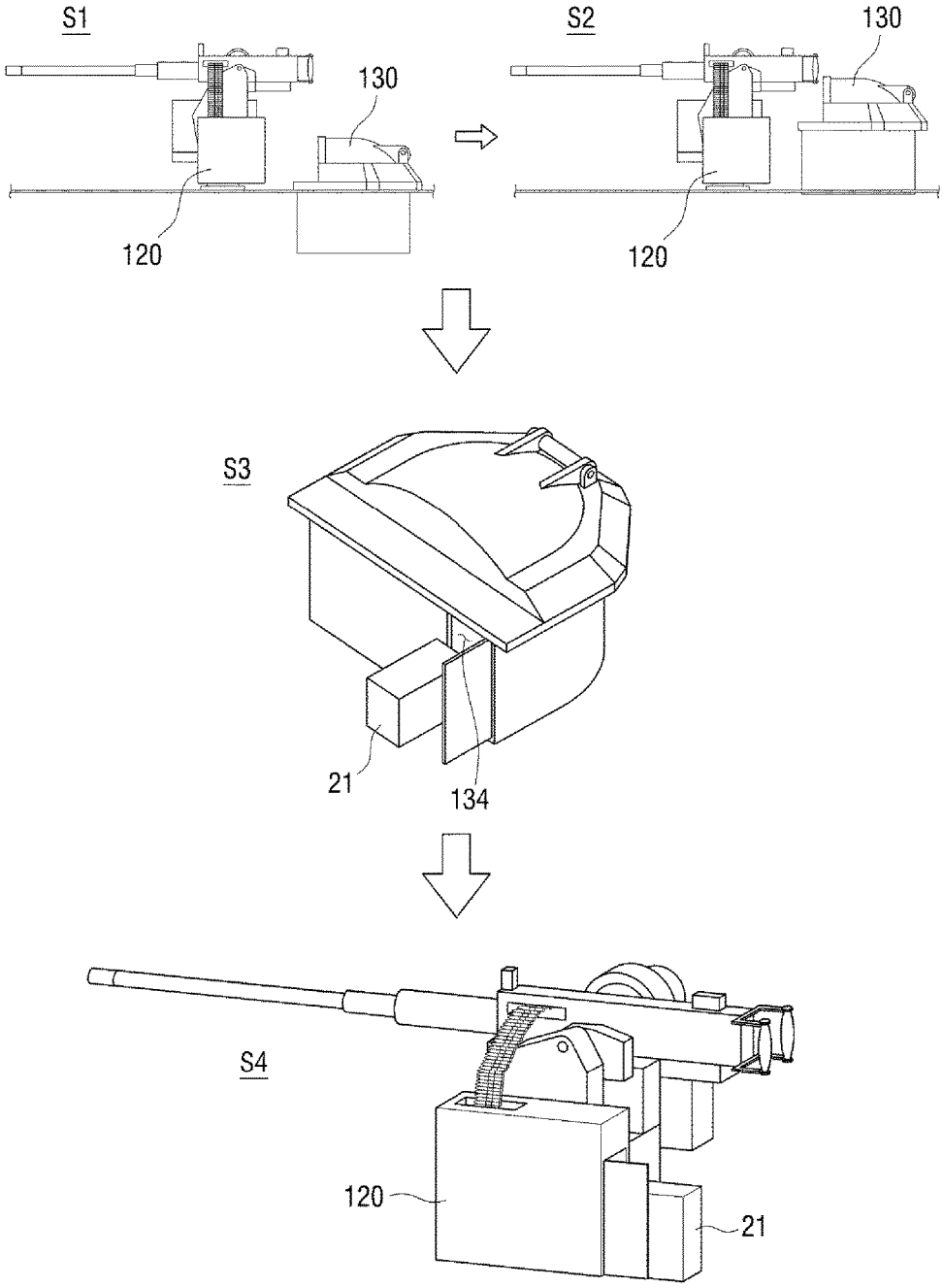
FIG. 12 illustrates a method of supplying the ammunition, using the ammunition supply system according to the exemplary embodiment.

FIG. 12 illustrates a method of supplying ammunition, using the ammunition supply system according to the exemplary embodiment. Referring to FIG. 12, the hatch unit 130 may be in a state where the hatch unit 130 is in a lowered position at the beginning (S1). The ammunition measuring unit 210 may measure the number of remaining ammunition loaded on the magazine loading unit 120. If the number of measured remaining ammunition is less than the reference value, the magazine replacement reporting unit 220 may output a magazine replacement alarm to the inside of the fighting vehicle 10. The magazine replacement alarm may be output in various ways, such as turning-on of a warning lamp, generation of a warning sound and a display of warning display on the display panel. In response to the the magazine replacement alarm being output, the hatch unit 130 in the lowered state may be changed to a state where the hatch unit 130 raised (S2). When the hatch unit 130 rises, the first opening 134 is opened and a magazine 21 may be carried out (S3). Further, the second opening 121 is opened, and the magazine 21 carried out via the first opening 134 may be loaded on the magazine loading unit 120 (S4).

Figure 13:
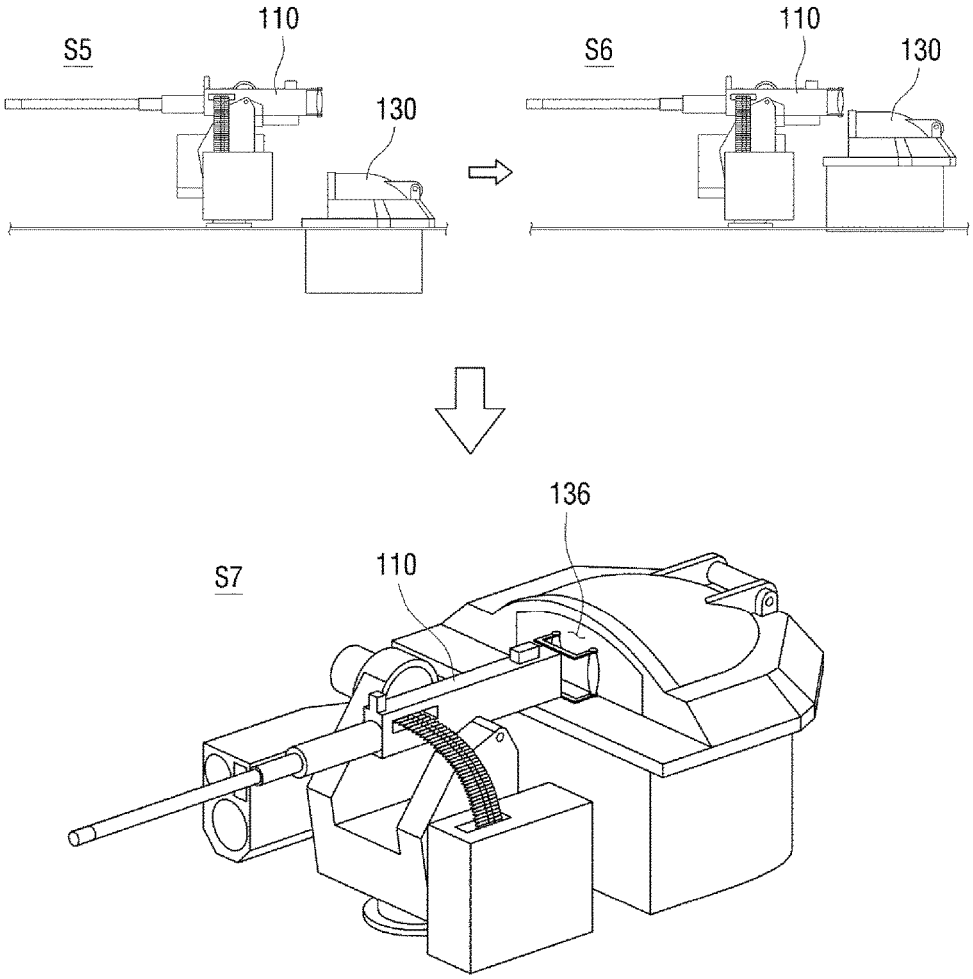
FIG. 13 illustrates a method of controlling a weapon, using the ammunition supply system according to the exemplary embodiment.

FIG. 13 illustrates a method of controlling a weapon 110 by applying the ammunition supply system according to the exemplary embodiment. Referring to FIG. 13, the hatch unit 130 may be in a lowered state at the beginning (S1). If there is a situation in which a combatant who gets on the fighting vehicle needs to directly operate the weapon 110 due to a failure of a system that automatically controls the weapon 110, the hatch unit 130 in the lowered state may be changed to a rising state (S2). The combatant, then, may manually operate the weapon through the third opening 136 opened toward the weapon 110 (S3).

Those having ordinary skill in the technical field to which the disclosure belongs will appreciate that the inventive concept of the disclosure may be implemented in other specific forms without changing its technical idea or essential features. It is therefore to be understood that the above-described exemplary embodiments are illustrative in all aspects and not restrictive. It is to be understood that the scope of the exemplary embodiments is defined by the appended claims rather than the above detailed description, and all changes or modifications that are derived from the meaning and range of the following claims and their equivalents should be interpreted as being within the scope of the inventive concept.

What is claimed is:

1. An ammunition supply system comprising:

a weapon mounted on an exterior of a fighting vehicle;

a magazine loading unit mounted on the exterior of the fighting vehicle and configured to load a magazine for the weapon;

a hatch unit configured to form an entrance to allow a combatant to enter and exit the fighting vehicle; and a hatch lifting unit configured to supply power to the hatch unit to move in a vertical direction with respect to the fighting vehicle, wherein the hatch unit includes:

a hatch door unit through which the combatant enters and exits the fighting vehicle, and a hatch passage part forming a passage for connecting the hatch door unit and an interior of the fighting vehicle, and wherein the hatch passage part includes a first opening facing the magazine loading unit so that the magazine is transferred from the interior of the fighting vehicle to the magazine loading unit without the combatant being exposed to the exterior of the fighting vehicle.

2. The ammunition supply system of claim 1, wherein the hatch passage part includes at least one outer wall which surrounds the passage, and a height of the at least one outer wall protruding to the exterior of the fighting vehicle changes as the hatch unit moves vertically.

3. The ammunition supply system of claim 2, wherein:

the at least one outer wall includes a plurality of outer walls, a diameter of one of the plurality of outer walls is different from a diameter of an adjacent outer wall, and at least two outer walls of the plurality of outer walls overlap each other in response the hatch unit being lowered.

4. The ammunition supply system of claim 1, wherein the first opening is exposed to the exterior of the fighting vehicle when the hatch unit rises.

5. The ammunition supply system of claim 1, wherein the hatch lifting unit includes at least one actuator configured to generate the power for the hatch unit to move vertically.

6. The ammunition supply system of claim 5, wherein the at least one actuator comprises a linear actuator configured to transmit the power to the hatch unit.

7. The ammunition supply system of claim 6, wherein a first end of the linear actuator is mounted on the fighting vehicle, and a second end opposite to the first end of the linear actuator is mounted to the hatch passage part.

8. The ammunition supply system of claim 5, wherein the hatch lifting unit further includes a power transmission unit configured to transmit the power generated by the at least one actuator to the hatch unit.

9. The ammunition supply system of claim 8, wherein:

the at least one actuator comprises a circular actuator configured to generate a rotational power, and the power transmission unit includes:

a first gear configured to be rotated by the generated rotational power, and a second gear configured to convert a rotation of the first gear into a linear power and configured to transmit the linear power to the hatch unit.

10. The ammunition supply system of claim 9, wherein:

the first gear is mounted on the fighting vehicle, and the second gear is mounted on the hatch passage part.

11. The ammunition supply system of claim 1, further comprising:

an ammunition measuring unit configured to measure a number of remaining ammunition loaded in the magazine loading unit; and a magazine replacement reporting unit configured to output a magazine replacement alarm for reporting replacement timing of the magazine when a number of the measured remaining ammunition is equal to or less than a reference value.

12. The ammunition supply system of claim 11, wherein the magazine replacement alarm is output through at least one of a warning lamp, a display panel, or a speaker mounted inside the fighting vehicle.

13. The ammunition supply system of claim 1, wherein the magazine loading unit comprises a second opening facing the first opening so that the magazine is loaded from the first opening.

14. The ammunition supply system of claim 13, wherein the hatch unit further comprises a first cover mounted at the first opening to open or close the first opening.

15. The ammunition supply system of claim 14, wherein:

the first cover is provided with a hinge provided at a lower end of the first cover, and is opened by rotating toward the outside of the fighting vehicle, and the first cover includes a stopper configured to restrict a rotation angle of the first cover so that an upper end of the first cover is located near a lower end of the second opening in an open state of the first opening.

16. The ammunition supply system of claim 15, wherein the first cover comprises a guide rail provided on the first cover and configured to guide the magazine sliding and moving from the interior of the fighting vehicle to the magazine loading unit.

17. The ammunition supply system of claim 14, wherein:

the first cover comprises a first hinge provided at a side end of the first cover, and is opened by rotating toward the outside of the fighting vehicle, and the first cover comprises:

an auxiliary cover opened and closed by a second hinge located at a lower end of the first cover; and a stopper configured to restrict a rotation angle of the auxiliary cover such that one end of the auxiliary cover is located near a lower end of the second opening in a state in which the first cover and the auxiliary cover are opened.

18. The ammunition supply system of claim 13, wherein the magazine loading unit further comprises a second cover mounted a the second opening.

19. The ammunition supply system of claim 1, wherein the hatch unit further comprises a third opening opened toward the weapon so as to allow the combatant to access the weapon.

20. The ammunition supply system of claim 19, wherein the third opening is exposed to the exterior of the fighting vehicle when the hatch unit moves upward.

* * * * *